US009261309B2

(12) United States Patent
Wang

(10) Patent No.: US 9,261,309 B2
(45) Date of Patent: Feb. 16, 2016

(54) LOOP HEAT PIPE AND MANUFACTURING METHOD THEREOF

(75) Inventor: Cheng Wang, Hsinchu (TW)

(73) Assignee: YOUNG GREEN ENERGY CO., Hsinchu County (TW)

( * ) Notice: Subject to any disclaimer, the term of this patent is extended or adjusted under 35 U.S.C. 154(b) by 1230 days.

(21) Appl. No.: 12/789,421

(22) Filed: May 27, 2010

(65) Prior Publication Data

US 2010/0307721 A1 Dec. 9, 2010

(30) Foreign Application Priority Data

Jun. 5, 2009 (TW) ..... 98118786 A

(51) Int. Cl.
*F28D 15/00* (2006.01)
*F28D 15/02* (2006.01)
*F28D 15/04* (2006.01)

(52) U.S. Cl.
CPC ..... *F28D 15/0266* (2013.01); *F28D 15/0283* (2013.01); *F28D 15/043* (2013.01); *Y10T 29/49353* (2015.01)

(58) Field of Classification Search
CPC F28D 15/0266; F28D 15/0283; F28D 15/043
USPC ..... 165/104.26, 104.21, 104.28, 104.33, 165/272, 274; 29/890.032
See application file for complete search history.

(56) References Cited

U.S. PATENT DOCUMENTS 6,381,135 B1 * 4/2002 Prasher et al. ..... 361/700
2007/0034355 A1 * 2/2007 Kuo ..... 165/80.4
2007/0175614 A1 * 8/2007 Li ..... 165/104.26
2008/0078530 A1 4/2008 Chang et al.
2010/0155019 A1 * 6/2010 Zhou et al. ..... 165/60

FOREIGN PATENT DOCUMENTS

| | | |
|---|---|---|
| TW | 592033 | 6/2004 |
| TW | M246563 | 10/2004 |
| TW | M256674 | 2/2005 |
| TW | I248781 | 2/2006 |
| TW | I265066 | 11/2006 |
| TW | 200724845 | 7/2007 |
| TW | 200724847 | 7/2007 |
| TW | I288224 | 10/2007 |

OTHER PUBLICATIONS

"Office Action of Taiwan Counterpart Application" with English translation thereof, issued on Feb. 16, 2012, p. 1-p. 19.

* cited by examiner

*Primary Examiner* — Travis Ruby
(74) *Attorney, Agent, or Firm* — Jianq Chyun IP Office

(57) ABSTRACT

A loop heat pipe for dissipating heat generated by a heat source includes a pipe, a first capillary structure, a second capillary structure, and a working fluid in the pipe. The pipe has a condensing section, an evaporating section adapted to contact the heat source thermally, and an obstructing section adjacent to the evaporating section. The first capillary structure on an inner surface of the pipe is disposed between the condensing section and the obstructing section. The second capillary structure has a first and a second parts connected with each other. The first part on the inner surface of the pipe is extended from the evaporating section to the obstructing section. The second part passing through the obstructing section is extended from the obstructing section to the condensing section. A space between the first capillary structure and the second part of the second capillary structure defines a compensation room.

13 Claims, 9 Drawing Sheets

LOOP HEAT PIPE AND MANUFACTURING METHOD THEREOF

CROSS-REFERENCE TO RELATED APPLICATION

This application claims the priority benefit of Taiwan application serial no. 98118786, filed Jun. 5, 2009. The entirety of the above-mentioned patent application is hereby incorporated by reference herein and made a part of specification.

BACKGROUND OF THE INVENTION

1. Field of the Invention

The invention relates to a heat pipe, in particularly, to a loop heat pipe.

2. Description of Related Art

The working principle of a heat pipe is to transfer heat through the evaporation and condensation of a working fluid. First, a liquid working fluid absorbs the heat generated from the heat-generating element adjacent to an evaporator of the heat pipe and evaporates to a vapor. When the vapor working fluid encounters a slight pressure difference, the vapor working fluid flows to a condenser of the heat pipe, and is condensed into liquid at the condenser and discharges heat. The liquid working fluid condensed at the condenser is transferred back to the evaporator through a capillary structure on the inner surface of the heat pipe. Therefore, the heat pipe is adapted for dissipating heat from the heat-generating element. Currently, several patents relating to the heat pipe are recited, such as US Patent No. 20080078530 and Taiwan Patent No. 1248781 and No. 592033.

Taiwan Utility Model Patent No. M256674 discloses a loop heat dissipating device, in which a liquid working fluid in a compensation room between two capillary structures may absorb heat and evaporate, and thus the pressure difference at two ends of the compensation room disappears, resulting in a problem that the vapor working fluid may not flow.

Taiwan Utility Model No. M246563 discloses a loop heat pipe. The hoop heat pipe uses a dense capillary structure to absorb a liquid working fluid, so as to prevent the liquid working fluid from flowing to the condenser. However, the dense capillary structure may firmly absorb the liquid working fluid, so the liquid working fluid is hard to be supplied to the evaporator.

SUMMARY OF THE INVENTION

The invention provides a loop heat pipe having good heat transfer efficiency.

The invention provides a method for manufacturing a loop heat pipe. The method may be used to manufacture the loop heat pipe having good heat transfer efficiency.

The invention further provides a method for manufacturing a loop heat pipe. The method may be used to manufacture the loop heat pipe.

The other objectives and advantages of the invention may be further understood from the technical features disclosed in the invention.

To achieve at least one aforementioned and other objectives, an embodiment of the invention provides a loop heat pipe adapted for dissipating heat generated by a heat source. The loop heat pipe includes a pipe, a first capillary structure, a second capillary structure, and a working fluid disposed in the pipe. The pipe has a first condensing section, an obstructing section, and a first evaporating section. The first evaporating section is adapted to contact the heat source thermally, and the obstructing section is adjacent to the first evaporating section. The first capillary structure is disposed on an inner surface of the pipe, and is disposed between the first condensing section and the obstructing section. The second capillary structure has a first part and a second part connected with the first part. The first part is disposed on the inner surface of the pipe and is extended from first evaporating section to the obstructing section. The second part is passing through the obstructing section and is extended from the obstructing section to the first condensing section. A space is maintained between the first capillary structure and the second part of the second capillary structure to define a compensation room.

In an embodiment, the invention provides a method for manufacturing a loop heat pipe. First, a pipe having a first end and a second end is provided. Then, a pressure is applied on the pipe locally to produce a flat deformation, so as to form an obstructing section between the first end and the second end. After that, a first capillary structure is formed in the pipe and disposed on an inner surface of the pipe, and the first capillary structure is disposed between the second end and the obstructing section. Thereafter, a second capillary structure having a first part and a second part connected with the first part is formed in the pipe. The first part is disposed on the inner surface of the pipe and is extended from the obstructing section to the first end. The second part is passing through the obstructing section and is extended from the obstructing section to the second end. A space is maintained between the first capillary structure and the second part of the second capillary structure to define a compensation room. Finally, a working fluid is filled in the pipe, and the first end and the second end are connected to seal the pipe.

In an embodiment, the invention provides a method for manufacturing a loop heat pipe. First, a first pipe having a first end and a second end is provided. In the first pipe, a first portion of a first capillary structure is formed on an inner surface of the first pipe, and the first portion of the first capillary structure is disposed at the second end. Then, a second pipe having a third end and a fourth end is provided. After that, a pressure is applied on the second pipe locally to produce a flat deformation, so as to form an obstructing section between the third end and the fourth end. Thereafter, a second portion of the first capillary structure and a second capillary structure are formed in the second pipe. The second portion of the first capillary structure is disposed on an inner surface of the second pipe and is extended from the obstructing section to the fourth end. The second capillary structure has a first part and a second part connected with the first part. The first part is disposed on the inner surface of the second pipe, and is extended from the obstructing section to the third end. The second part is passing through the obstructing section and is extended from the obstructing section to the fourth end. Then, a working fluid is filled in the first pipe. Finally, the first end and the third end are connected and the second end and the fourth end are connected to seal the first pipe and the second pipe. The first portion and the second portion of first capillary structure are connected, and a space is maintained between the second portion of the first capillary structure and the second part of the second capillary structure to define a compensation room.

In the above embodiments of the invention, the loop heat pipe may supply the liquid working fluid rapidly in a large amount from the first capillary structure to the second capillary structure through the compensation room, so as to prevent interruption of the transmission of the liquid working fluid, and thus the loop heat pipe has good heat transfer efficiency.

Other objectives, features and advantages of the invention will be further understood from the further technological features disclosed by the embodiments of the invention wherein there are shown and described preferred embodiments of this invention, simply by way of illustration of modes best suited to carry out the invention.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

In the following detailed description of the preferred embodiments, reference is made to the accompanying drawings which form a part hereof, and in which are shown by way of illustration specific embodiments in which the invention may be practiced. In this regard, directional terminology, such as "top," "bottom," "front," "back," etc., is used with reference to the orientation of the Figure(s) being described. The components of the invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Similarly, the terms "facing," "faces" and variations thereof herein are used broadly and encompass direct and indirect facing, and "adjacent to" and variations thereof herein are used broadly and encompass directly and indirectly "adjacent to". Therefore, the description of "A" component facing "B" component herein may contain the situations that "A" component directly faces "B" component or one or more additional components are between "A" component and "B" component. Also, the description of "A" component "adjacent to" "B" component herein may contain the situations that "A" component is directly "adjacent to" "B" component or one or more additional components are between "A" component and "B" component. Accordingly, the drawings and descriptions will be regarded as illustrative in nature and not as restrictive.

Figure 1:
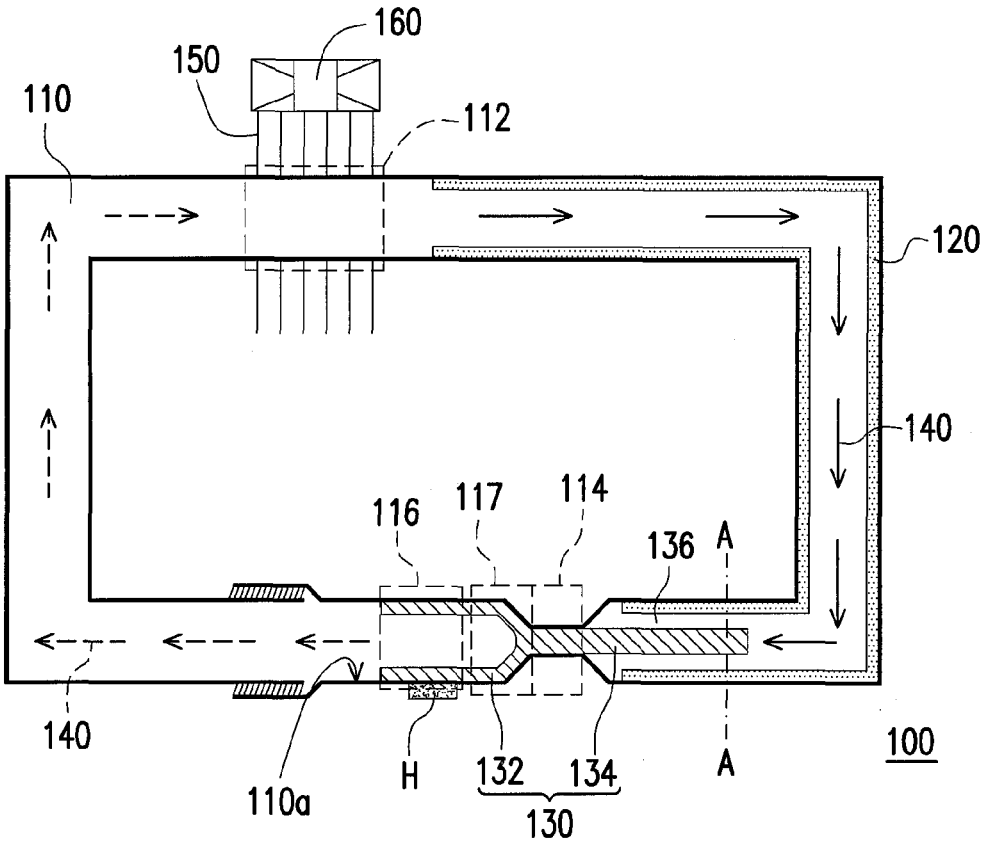
FIG. 1 is a schematic view of a loop heat pipe according to an embodiment of the invention.
Figure 2:
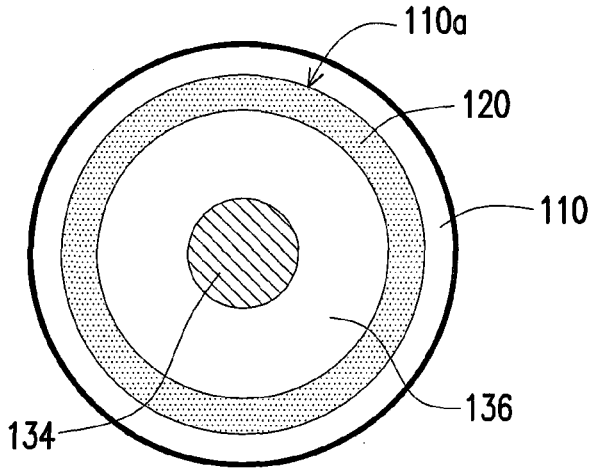
FIG. 2 is a sectional view of the loop heat pipe taken along line A-A in FIG. 1.

Referring to FIGS. 1 and 2, in this embodiment, the loop heat pipe 100 is adapted for dissipating heat generated from a heat source H. The loop heat pipe 100 includes a pipe 110, a first capillary structure 120, a second capillary structure 130, and a working fluid 140 in the pipe 110. The working fluid 140 may be water, acetone, ammonia, or other fluids. The pipe 110 has a first condensing section 112, an obstructing section 114, and a first evaporating section 116. The first evaporating section 116 is adapted to contact the heat source H thermally and the obstructing section 114 is adjacent to the first evaporating section 116.

In addition, the first capillary structure 120 is disposed on an inner surface 110*a* of the pipe 110 and is disposed between the first condensing section 112 and the obstructing section 114. The second capillary structure 130 has a first part 132 and a second part 134 connected with the first part 132. Specifically, the first part 132 is disposed on an inner surface 110*a* of the pipe 110 and is extended from the first evaporating section 116 to the obstructing section 114. The second part 134 is passing through the obstructing section 114 and is extended from the obstructing section 114 to the first condensing section 112. In this embodiment, the second part 134 of the second capillary structure 130 is substantially disposed in a central part of the pipe 110.

The first evaporating section 116 thermally contacts the heat source H, so the heat generated from the heat source H is transferred to the first evaporating section 116, such that the working fluid 140 in the first evaporating section 116 evaporates from the liquid (indicated by the solid arrows) into the vapor (indicated by the dotted arrows). Then, the vapor working fluid 140 flows from the first evaporating section 116 to the first condensing section 112, wherein the temperature of the first condensing section 112 is lower than the first evaporating section 116, and the vapor working fluid 140 is condensed to the liquid working fluid 140 at the first condensing section 112. Therefore, the vapor working fluid 140 at the first evaporating section 116 increases gradually, and the vapor working fluid 140 at the first condensing section 112 decreases gradually. In this manner, the vapor working fluid 140 continuously flows from the first evaporating section 116 to the first condensing section 112 under the pressure difference.

In addition, the liquid working fluid 140 at the first evaporating section 116 continuously evaporates into the vapor working fluid 140 and the amount of the liquid working fluid 140 decreases gradually, thereby causing the capillary action to make the liquid working fluid 140 at the first condensing section 112 be transferred to the first evaporating section 116 sequentially through the first capillary structure 120 and the second capillary structure 130. Till now, the circulation of the working fluid 140 is completed. By means of the continuous circulation of the working fluid 140, the heat generated from the heat source H is continuously transferred to the first condensing section 112, and then is dissipated to the outside. Furthermore, in this embodiment, the working fluid 140 flows under the pressure difference between the first condensing section 112 and the first evaporating section 116 and the capillary action of the first capillary structure 120 and the second capillary structure 130. Relatively, the gravity shows little impact on the heat dissipation efficiency of the loop heat pipe 100 of this embodiment. Therefore, the loop heat pipe 100 of this embodiment may be placed in any direction as desired, for example, may be placed horizontally or vertically.

Furthermore, in order to rapidly dissipate the heat carried by the working fluid 140 from the first condensing section 112 to the outside, the loop heat pipe 100 may further include a first fin assembly 150 and a first fan 160. Specifically, the first fin assembly 150 is thermally connected with the first condensing section 112, and the first fan 160 is disposed at the first fin assembly 150. Therefore, the heat carried by the working fluid 140 may be transferred to the first fin assembly 150 and then rapidly dissipated to the air by the air flow produced by the first fan 160.

A space is maintained between the first capillary structure 120 and the second part 134 of the second capillary structure 130 to define a compensation room 136. Therefore, the liquid working fluid 140 adsorbed by the first capillary structure 120 is firstly transferred to the compensation room 136, and then transferred to the second part 134 of the second capillary structure 130. In this manner, the liquid working fluid 140 is transferred from the first condensing section 112 to the compensation room 136 through the first capillary structure 120, and is transferred to the first evaporating section 116 through the second capillary structure 130 from the compensation room 136. By means of the compensation room 136, the liquid working fluid 140 may be supplied rapidly in a large amount to the second capillary structure 130, so as to prevent interruption of the transmission of the liquid working fluid 140.

Moreover, the second capillary structure 130 may not only rapidly supply the liquid working fluid 140 to the first evaporating section 116 but also prevent the vapor working fluid 140 at the first evaporating section 116 from flowing in an opposite direction. In brief, the resistance encountered by the vapor working fluid 140 at the first evaporating section 116 when flowing to the first condensing section 112 is smaller than the resistance encountered when flowing to the obstructing section 114. Therefore, when the vapor working fluid 140 at the first evaporating section 116 increases gradually, the vapor working fluid 140 may flow towards the first condensing section 112. In this manner, the vapor working fluid 140 and the liquid working fluid 140 are prevented from flowing in opposite directions in the pipe 110. In addition, in this embodiment, the second part 134 of the second capillary structure 130 may be a column, and a diameter of the second part 134 may be the same as an inner diameter of the obstructing section 114.

In another aspect, in this embodiment, a distance may be maintained between the obstructing section 114 and the first evaporating section 116 (or the heat source H) to define a sub-cooling region 117. The first part 132 of the first capillary structure 130 in the sub-cooling region 117 is disposed on the inner surface 110*a* of the pipe 110, and thus the liquid working fluid 140 adsorbed by the first part 132 flows along the wall of the pipe 110, so as to maintain the cooling status of the sub-cooling region 117.

Figure 3:
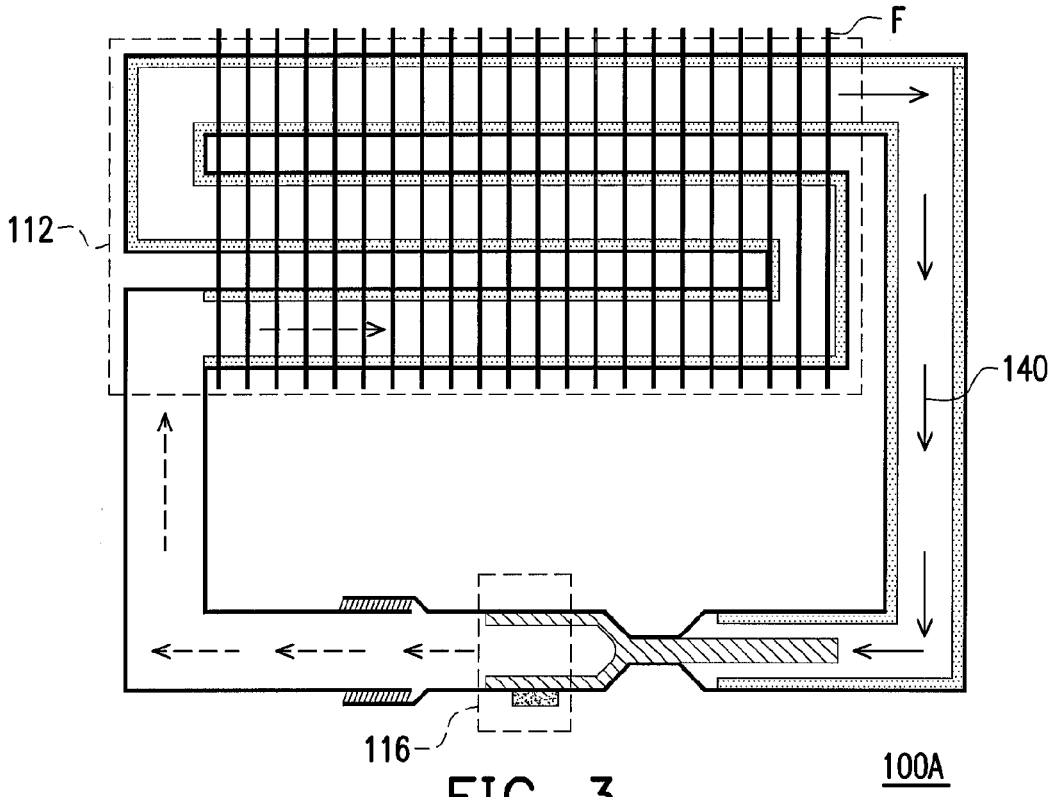
FIG. 3 is a schematic view of a loop heat pipe according to another embodiment of the invention.

Referring to FIG. 3, in this embodiment, the first condensing section 112 of the loop heat pipe 100A is in the shape of continuous bends to improve the heat dissipation efficiency. Specifically, the first condensing section 112 in the shape of continuous bends allows more or larger heat dissipating fins F to be disposed thereon for facilitating the heat dissipation, and enables the loop heat pipe 100A to achieve an equivalent heat dissipation effect in a smaller assembly room.

A loop heat pipe adapted for dissipating heat generated from multiple heat sources is provided in the following, so as to meet different design requirements.

Figure 4:
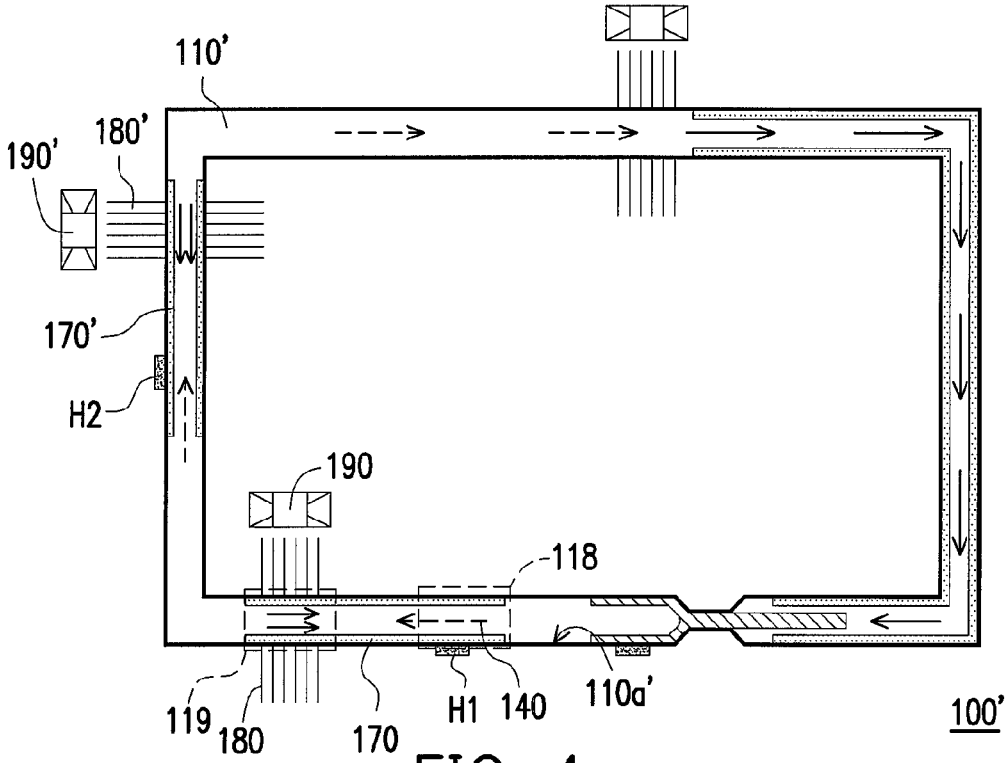
FIG. 4 is a schematic view of a loop heat pipe according to yet another embodiment of the invention.

Referring to FIG. 4, the loop heat pipe 100' of this embodiment additionally has a third capillary structure 170, a second fin assembly 180, and a second fan 190 after the another heat source H1, so as to dissipate heat generated from the heat source H1.

Specifically, the pipe 110' further includes a second evaporating section 118 and a second condensing section 119. The second evaporating section 118 thermally contacts the heat source H1. The third capillary structure 170 is disposed on an inner surface 110*a'* of the pipe 110' and is extended from the second evaporating section 118 to the second condensing section 119. Further, the second fin assembly 180 is thermally connected with the second condensing section 119, and the second fan 190 is disposed at the second fin assembly 180. In this manner, a part of the working fluid 140 passing through the heat source H1 is condensed from the vapor to the liquid by the second fin assembly 180 and the second fan 190, and flows to the heat source H1 along the third capillary structure 170, so as to cool down the heat source H1.

Similarly, in this embodiment, a third capillary structure 170', a second fin assembly 180', and a second fan 190' may be added after another heat source H2, so as to dissipate heat generated from the heat source H2. The actuation mode for the loop heat pipe 100' to dissipate the heat generated from the heat source H2 is similar to that for the heat source H1, and the details may not be repeated herein. From the above, the loop heat pipe 100' of this embodiment may dissipate the heat generated from multiple heat sources H, H1, H2 simultaneously without increasing the number of the pipe 110'. Therefore, the loop heat pipe 100' meets the requirements for slim products and also reduces the manufacturing cost.

Figure 5A:
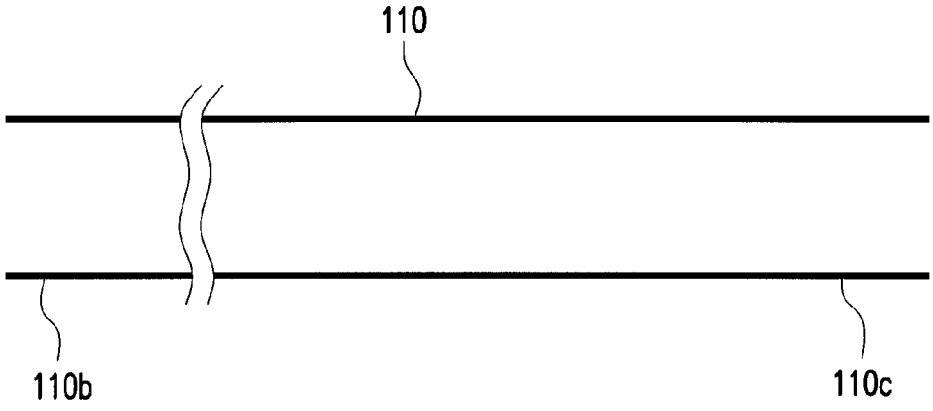
FIGS. 5A to 5D show a method for manufacturing the loop heat pipe in FIG. 1.
Figure 5B:
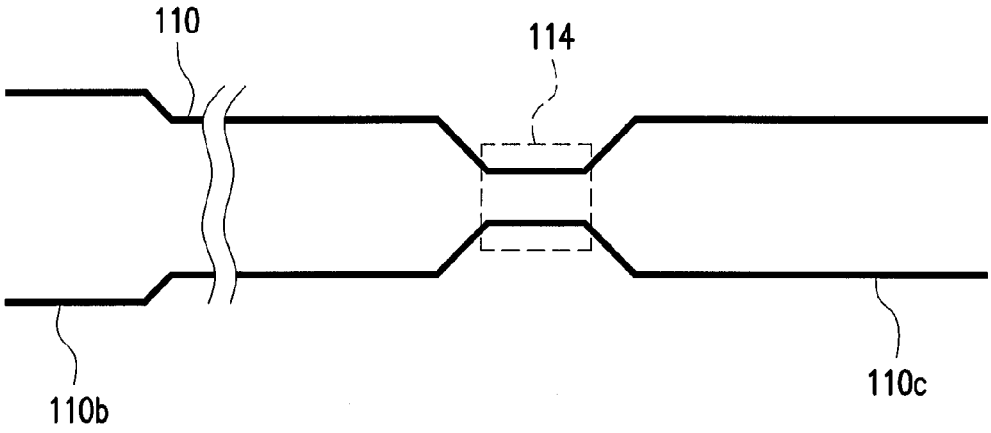

Referring to FIGS. 5A and 5B, firstly, a pipe 110 having a first end 110*b* and a second end 110*c* is provided. Then, a pressure is applied between the first end 110*b* and the second end 110*c* of the pipe 110 to produce a flat deformation, so as to form an obstructing section 114. Furthermore, the first end 110*b* may be enlarged so as to facilitate the connection of the second end 110*c* and the first end 110*b* of the pipe 110.

Figure 5C:
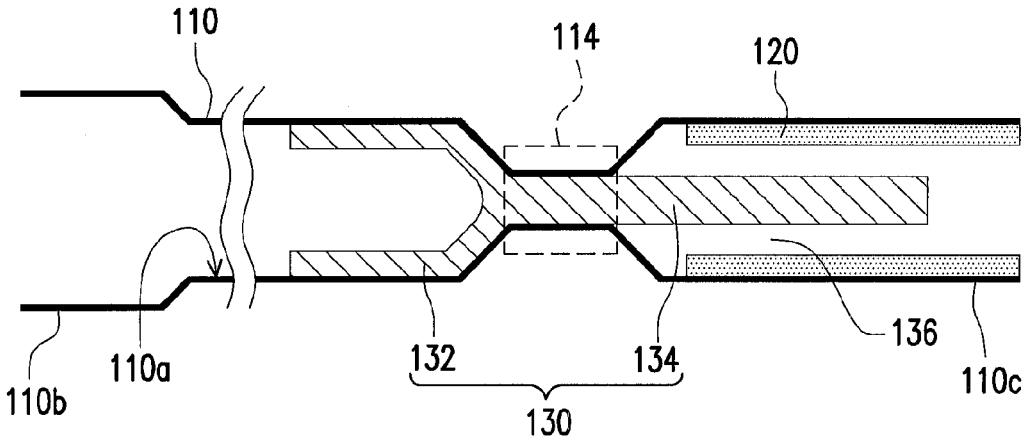

After that, referring to FIG. 5C, a first capillary structure 120 is formed on an inner surface 110*a* of the pipe 110, and the first capillary structure 120 is disposed between the second end 110*c* and the obstructing section 114. Then, a second capillary structure 130 having a first part 132 and a second part 134 connected with the first part 132 is formed in the pipe 110. The method for forming the first capillary structure 120 and the second capillary structure 130 includes filling a capillary powder and sintering the capillary powder. Specifically, the first part 132 is disposed on the inner surface 110*a* and is extended from the obstructing section 114 to the first end 110*b*. The second part 134 is passing through the obstructing section 114 and is extended from the obstructing section 114 to the second end 110*c*.

Figure 5D:
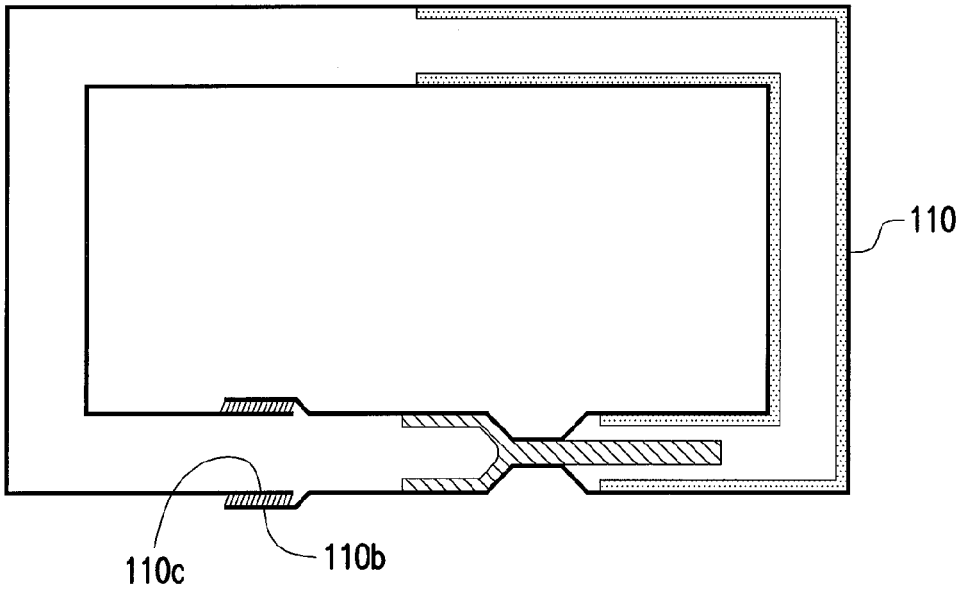

A space is maintained between the first capillary structure 120 and the second part 134 of the second capillary structure 130 to define a compensation room 136. By means of the compensation room 136, the working fluid 140 is supplied rapidly in a large amount to the second capillary structure 130, and thus the loop heat pipe 100 has good heat transmission efficiency. Then, the pipe 110 is placed in a vacuum cabinet, and a working fluid is filled in the pipe 110. Referring to FIG. 5D, thereafter, the pipe 110 is bent, and the first end 110*b* and the second end 110*c* of the pipe 110 are connected. Finally, the pipe 110 is sealed. In this embodiment, the pipe 110 may be sealed by, for example, welding the overlapped part of the first end 110*b* and the second end 110*c*. Till now, the manufacturing of the loop heat pipe 100 is completed.

Figure 6A:
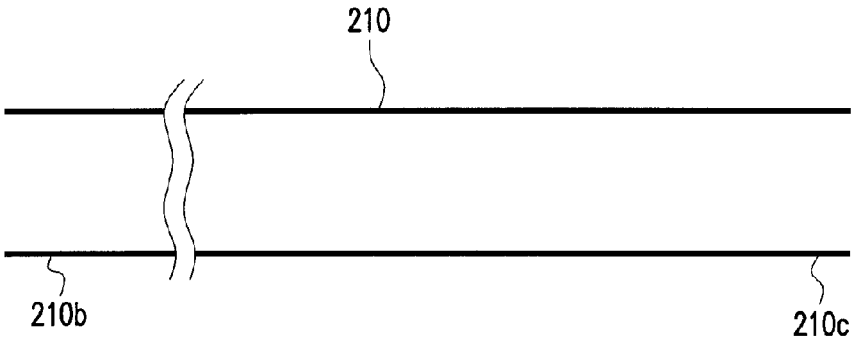
FIGS. 6A to 6G show a method for manufacturing a loop heat pipe according to an embodiment of the invention.
Figure 6B:
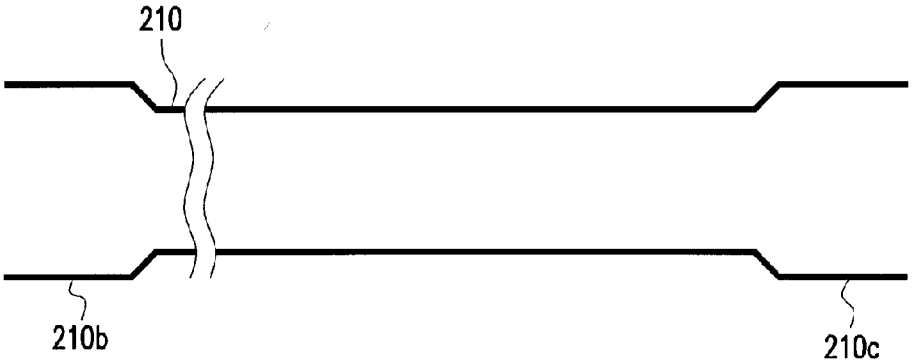
Figure 6C:
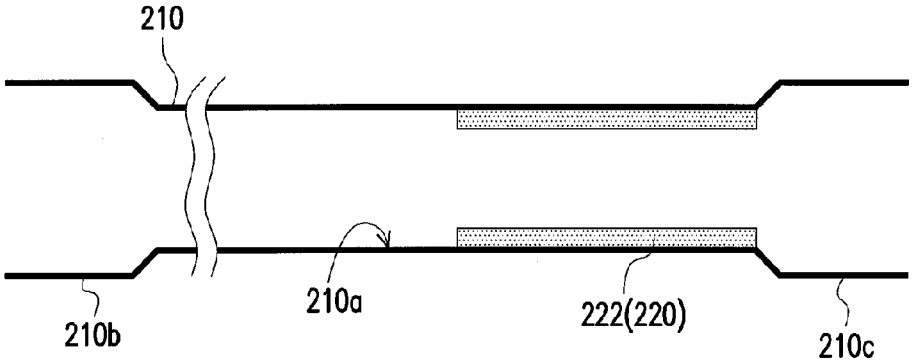

Referring to FIGS. 6A, 6B, and 6C, firstly, a first pipe 210 having a first end 210*b* and a second end 210*c* is provided. Then, the first end 210*b* and the second end 210*c* are respectively enlarged to facilitate the subsequent assembly process. A first portion 222 of a first capillary structure 220 is formed on an inner surface 210*a* of the first pipe 210, and the first portion 222 of the first capillary structure 220 is disposed at the second end 210*c*.

Figure 6D:
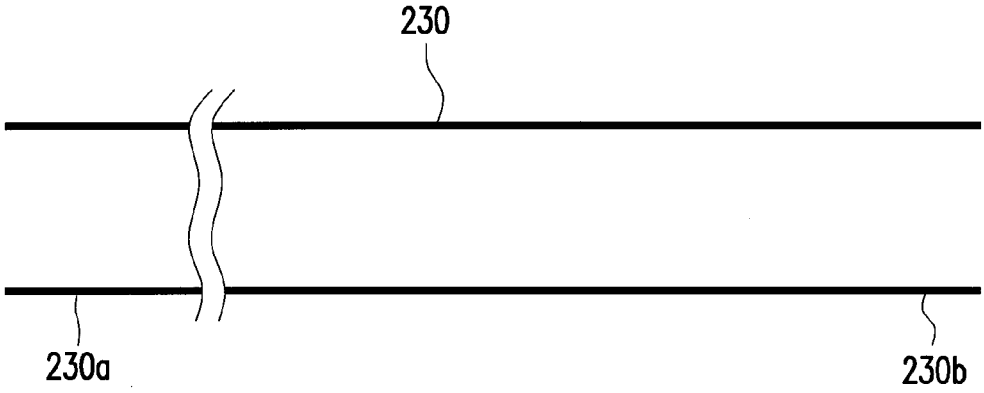
Figure 6E:
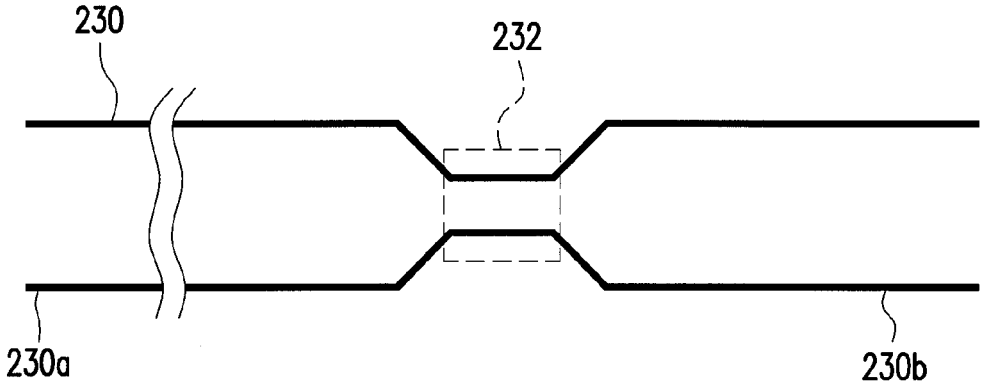
Figure 6F:
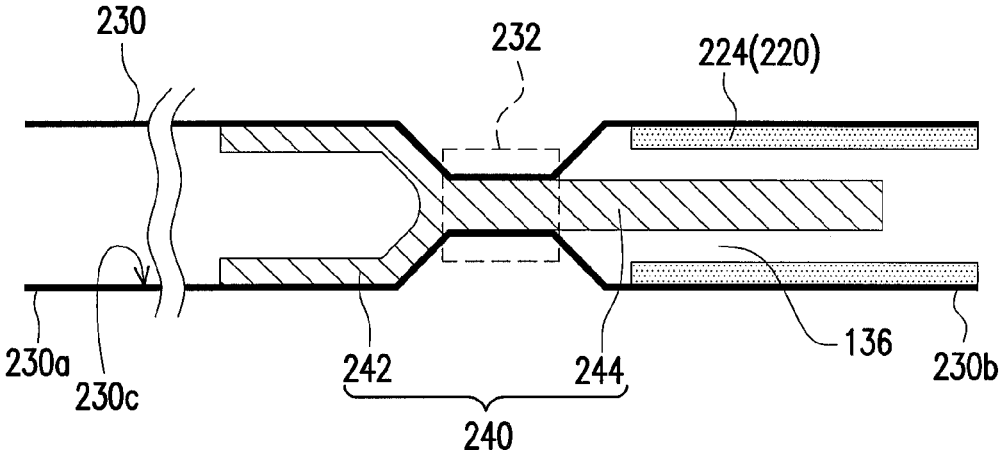

Referring to FIGS. 6D, 6E, and 6F, a second pipe 230 having a third end 230*a* and a fourth end 230*b* is provided. Then, a pressure is applied between the third end 230*a* and the fourth end 230*b* of the second pipe 230 to produce a flat deformation, so as to form an obstructing section 232. After that, a second portion 224 of the first capillary structure 220 and a second capillary structure 240 are formed in the second pipe 230. The method for forming the first capillary structure 220 and the second capillary structure 240 includes filling a capillary powder and sintering the capillary powder.

Specifically, the second portion 224 of the first capillary structure 220 is disposed on an inner surface 230*c* of the second pipe 230 and is extended from the obstructing section 232 to the fourth end 230*b*. The second capillary structure 240 has a first part 242 and a second part 244 connected with the first part 242. In detail, the first part 242 is disposed on an inner surface 230*a* of the second pipe 230 and is extended from the obstructing section 232 to the third end 230*a*. The second part 244 is passing through the obstructing section 232 and is extended from the obstructing section 232 to the fourth end 230*b*.

Figure 6G:
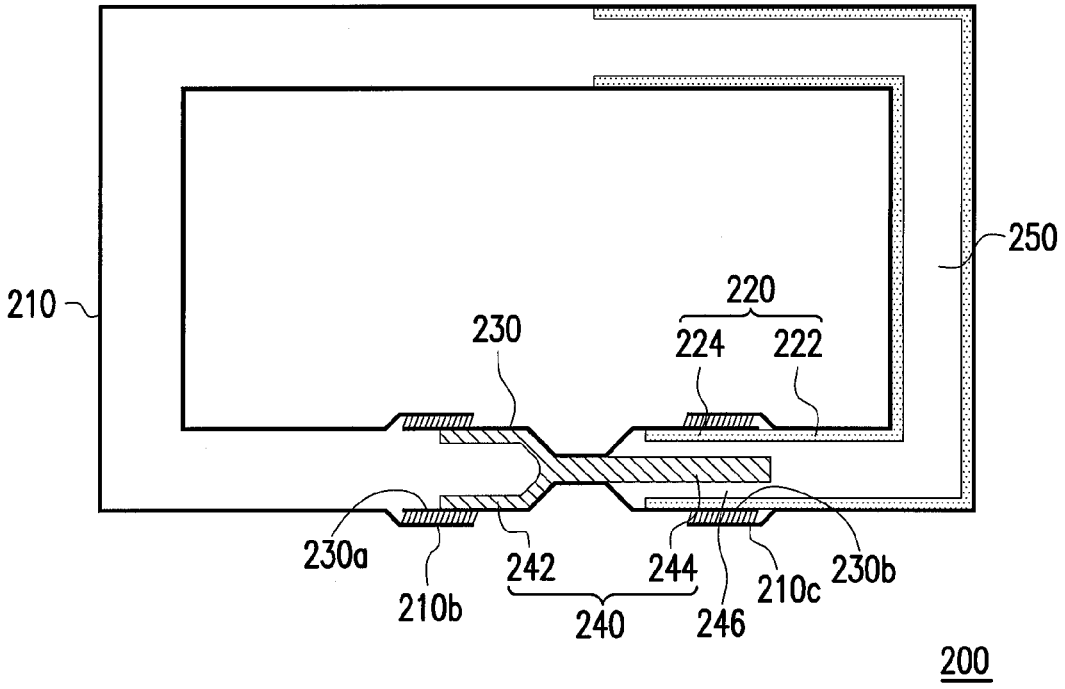

Then, referring to FIG. 6G, the first pipe 210 and the second pipe 230 are placed in a vacuum cabinet, and a working fluid 250 is filled in the first pipe 210. After that, the first end 210*b* of the first pipe 210 and the third end 230*a* of the second pipe 230 are connected, and the second end 210*c* of the first pipe 210 and the fourth end 230*b* of the second pipe 230 are connected. Finally, the first pipe 210 and the second pipe 230 are sealed. Till now, the manufacturing of the loop heat pipe 200 is completed.

The first portion 222 and the second portion 224 of the first capillary structure 220 are connected, and a space is maintained between the second portion 224 of the first capillary structure 220 and the second part 244 of the second capillary structure 240 to define a compensation room 246. By means of the compensation room 246, the loop heat pipe 200 may supply the liquid working fluid 250 rapidly in a large amount from the first capillary structure 220 to the second capillary structure 240, so as to prevent interruption of the transmission of the liquid working fluid 250.

Figure 7:
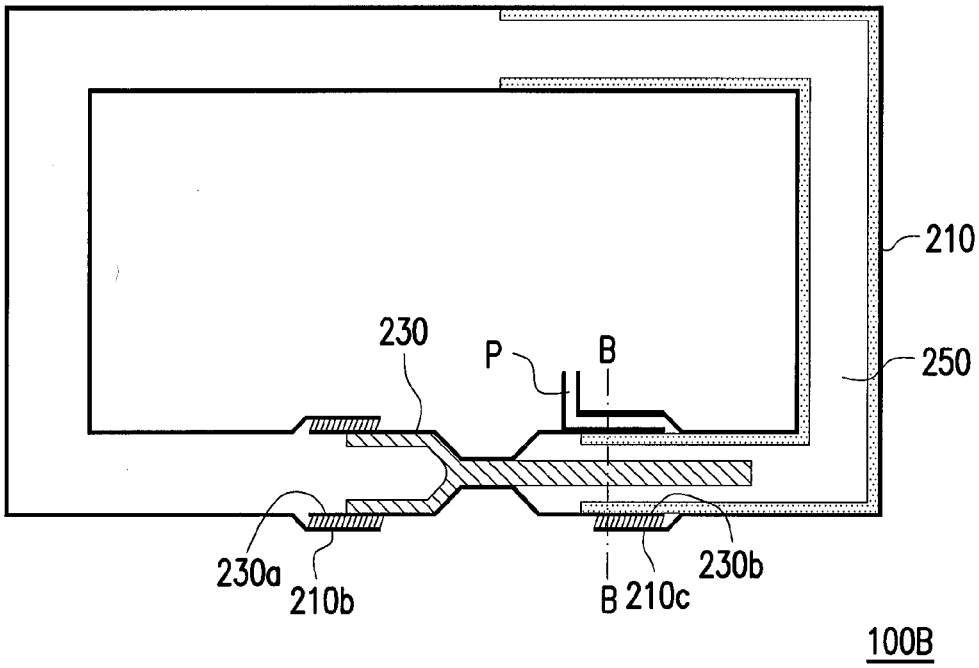
FIG. 7 is a schematic view of a loop heat pipe according to another embodiment of the invention.
Figure 8:
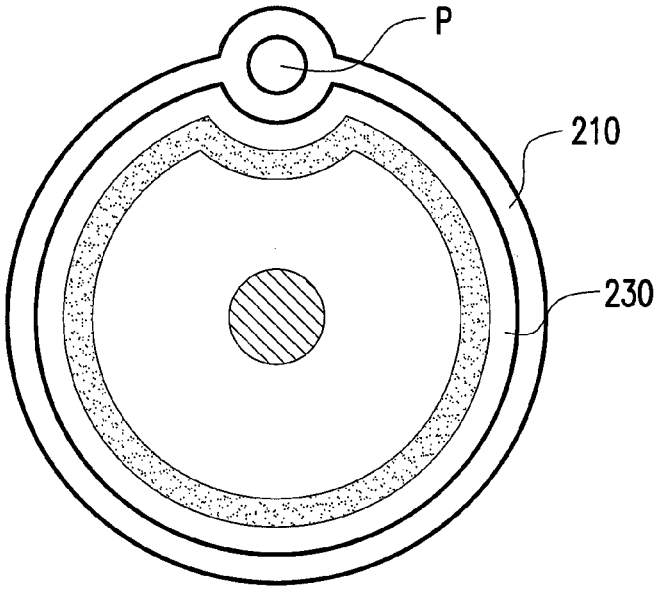
FIG. 8 is a sectional view of the loop heat pipe taken along line B-B in FIG. 7.

Referring to FIGS. 7 and 8, in this embodiment, a transmission pipe P is firstly connected to the second end 210*c* of the first pipe 210. Then, the first end 210*b* of the first pipe 210 and the third end 230*a* of the second pipe 230 are connected, and the second end 210*c* of the first pipe 210 and the fourth end 230*b* of the second pipe 230 are connected. After that, the air in the first pipe 210 and the second pipe 230 is evacuated through a transmission pipe P. Then, a working fluid 250 is filled in the first pipe 210. In this manner, the working fluid 250 may be filled in the first pipe 210 through the transmission pipe P without placing the loop heat pipe 100B in the vacuum cabinet.

In addition, in the method for manufacturing a loop heat pipe shown in FIGS. 6A to 6G, a transmission pipe may be firstly connected to the pipe, and then the first end and the second end of the pipe are connected. The air in the pipe is evacuated through the transmission pipe. Then, the working fluid is filled in the pipe. In this manner, the working fluid may be filled in the pipe without placing the loop heat pipe in the vacuum cabinet.

Figure 9:
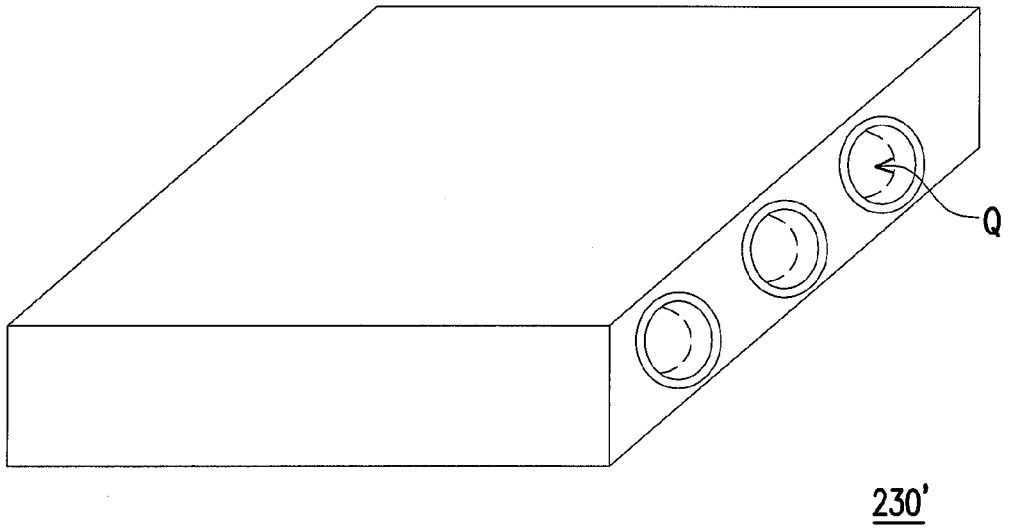
FIG. 9 is a schematic view of components of a loop heat pipe according to another embodiment of the invention.

Referring to FIGS. 6G and 9, the difference from the above embodiment lies in that the components of the loop heat pipe of this embodiment may be manufactured without using the second pipe 230 in the above embodiments. For example, the first capillary structure may be disposed on the interior of a via hole Q of a base 230' and the second capillary structure may be disposed on the periphery of the via hole Q. After that, the first pipe 210 of the aforementioned embodiment is connected thereto to form the loop heat pipe.

In view of the above, the embodiment or the embodiments of the invention may have at least one of the following advantages, the loop heat pipe in the above embodiments of the invention may supply the liquid working fluid rapidly in a large amount from the first capillary structure to the second capillary structure by means of the compensation room, so as to prevent the interruption of the transmission of the liquid working fluid, and thus the loop heat pipe has good heat transfer efficiency. Further, the gravity shows little impact on the heat dissipation efficiency of the loop heat pipe. Therefore, the loop heat pipe may be placed freely. Further, the first condensing section may be in the shape of continuous bends to increase the heat dissipation area, thereby improving the heat dissipation efficiency. Meanwhile, the first condensing section in the shape of continuous bends allows more or larger heat dissipating fins to be disposed thereon for facilitating the heat dissipation, and enables the loop heat pipe to achieve an equivalent heat dissipation effect in a smaller assembly room. In addition, the loop heat pipe is capable of dissipating the heat generated from multiple heat sources simultaneously, so as to meet the requirements for slim products and also reduce the manufacturing cost.

The foregoing description of the preferred embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the invention" or the like does not necessarily limit the claim scope to a specific embodiment, and the reference to particularly preferred exemplary embodiments of the invention does not imply a limitation on the invention, and no such limitation is to be inferred. The invention is limited only by the spirit and scope of the appended claims. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the invention as defined by the following claims.

Moreover, no element and component in the disclosure is intended to be dedicated to the public regardless of whether the element or component is explicitly recited in the following claims.

What is claimed is:

1. A loop heat pipe, adapted for dissipating heat generated by at least one heat source, comprising:

a pipe, having a first condensing section, an obstructing section, and a first evaporating section, wherein the first evaporating section is adapted to contact a first heat source thermally and the obstructing section is adjacent to the first evaporating section;

a first capillary structure, disposed on an inner surface of the pipe and disposed between the first condensing section and the obstructing section;

a second capillary structure, having a first part and a second part connected with the first part, wherein the first part is disposed on the inner surface of the pipe and is extended from the first evaporating section to the obstructing section, the second part is passing through the obstructing section and is extended from the obstructing section to the first condensing section, wherein the second part of the second capillary structure is disposed in a central part of the pipe, the second part extended from the obstructing section is surrounded by the first capillary structure, and a space is maintained between the first capillary structure and the second part of the second capillary structure to define a compensation room;

a working fluid, disposed in the pipe;

a flow channel, disposed between the first condensing section and the obstructing section, wherein the flow channel surrounded by the first capillary structure transmits the working fluid to the compensation room; and a third capillary structure, wherein the pipe further comprises a second evaporating section and a second condensing section, the second evaporating section is adapted to contact a second heat source thermally, and the third capillary structure is disposed on the inner surface of the pipe and is extended from the second evaporating section to the second condensing section, wherein the first condensing section, the first heat source, the second heat source and the second condensing section are arranged in series, and a part of the working fluid is condensed from vapor to liquid by the second condensing section and flows back to the second heat source along the third capillary structure in a direction opposite to a flowing direction of the vapor working fluid, so as to cool down the second heat source.

2. The loop heat pipe according to claim 1, wherein a distance is maintained between the obstructing section and the first evaporating section to define a sub-cooling region.

3. The loop heat pipe according to claim 1, wherein the second part of the second capillary structure is a column, and a diameter of the second part is the same as an inner diameter of the obstructing section.

4. The loop heat pipe according to claim 1, wherein the working fluid is transferred from the first condensing section to the compensation room through the first capillary structure, and is transferred to the first evaporating section through the second capillary structure from the compensation room.

5. The loop heat pipe according to claim 1, further comprising a first fin assembly thermally connected with the first condensing section.

6. The loop heat pipe according to claim 5, further comprising a first fan disposed at the first fin assembly.

7. The loop heat pipe according to claim 1, wherein the first condensing section is in a shape of continuous bends.

8. The loop heat pipe according to claim 1, further comprising a second fin assembly thermally connected with the second condensing section.

9. The loop heat pipe according to claim 8, further comprising a second fan disposed at the second fin assembly.

10. A method for manufacturing a loop heat pipe adapted for dissipating heat generated by at least one heat source, comprising:

providing a pipe having a first end, a second end, a first condensing section, a first evaporating section, a second condensing section and a second evaporating section, wherein the first condensing section is located at the second end, the first evaporating section, the second condensing section and the second evaporating section are located at the first end, the first evaporating section is adapted to contact a first heat source thermally, the second evaporating section is adapted to contact a second heat source thermally, and the first condensing section, the first heat source, the second heat source and the second condensing section are arranged in series;

applying pressure locally on the pipe to produce a flat deformation, so as to form an obstructing section between the first condensing section and the first evaporating section;

forming a first capillary structure in the pipe, wherein the first capillary structure is disposed on an inner surface of the pipe and is disposed between the first condensing section and the obstructing section;

forming a second capillary structure in the pipe, wherein the second capillary structure has a first part and a second part connected with the first part, the first part is disposed on the inner surface of the pipe and is extended from the obstructing section to the first evaporating section, the second part is passing through the obstructing section and is extended from the obstructing section to the first condensing section, wherein the second part of the second capillary structure is disposed in a central part of the pipe, the second part extended from the obstructing section is surrounded by the first capillary structure, and a space is maintained between the first capillary structure and the second part of the second capillary structure to define a compensation room;

forming a third capillary structure in the pipe, wherein the third capillary structure is disposed on the inner surface of the pipe and is extended from the second evaporating section to the second condensing section;

filling a working fluid in the pipe; and connecting the first end and the second end to seal the pipe, wherein a part of the working fluid is condensed from vapor to liquid by the second condensing section and flows back to the second heat source along the third capillary structure in a direction opposite to a flowing direction of the vapor working fluid, so as to cool down the second heat source.

11. The method for manufacturing a loop heat pipe according to claim 10, further comprising evacuating air in the pipe before filling the working fluid in the pipe.

12. The method for manufacturing a loop heat pipe according to claim 10, wherein the step of filling the working fluid in the pipe comprises connecting a transmission pipe to the pipe and filling the working fluid in the pipe through the transmission pipe.

13. The method for manufacturing a loop heat pipe according to claim 10, further comprising connecting a transmission pipe to the pipe and evacuating air in the pipe through the transmission pipe after connecting the first end and the second end.

* * * * *